US005751100A

United States Patent [19]

Kim

[11] Patent Number: 5,751,100

[45] Date of Patent: May 12, 1998

[54] ELECTRON GUN FOR A COLOR CATHODE RAY TUBE

[75] Inventor: Changhoe Kim, Seoul, Rep. of Korea

[73] Assignee: Samsung Display Devices Co., Ltd., Kyungki-do, Rep. of Korea

[21] Appl. No.: 659,710

[22] Filed: Jun. 10, 1996

[30] Foreign Application Priority Data

Dec. 30, 1995 [KR] Rep. of Korea ..... 95-68202

[51] Int. Cl.[6] ..... H01J 29/56

[52] U.S. Cl. ..... 313/414; 313/412; 313/425; 313/426

[58] Field of Search ..... 313/412, 414, 313/425, 426, 427, 428, 432, 439, 442, 443

[56] References Cited

U.S. PATENT DOCUMENTS 4,728,859 3/1988 Natsuhara et al. ..... 313/414

5,081,393 1/1992 Kinami ..... 313/414

FOREIGN PATENT DOCUMENTS 206708 1/1996 Taiwan .

*Primary Examiner*—Sandra L. O'Shea
*Assistant Examiner*—Vip Patel
*Attorney, Agent, or Firm*—Christie, Parker & Hale, LLP

[57] ABSTRACT

An electron gun for a color cathode ray tube taking a multi-level focusing form includes a focusing electrode and a pre-focusing electrode. The distances between the centers of the apertures of the focusing electrode are larger than the distances between the corresponding apertures of the pre-focusing electrode. The electron gun further includes a post-focusing electrode. The distances between the centers of the apertures of the focusing electrode are larger than those of the corresponding apertures of the post-focusing electrode. But, the center distances between the apertures of the pre-focusing electrode are equal to the center distances between the corresponding apertures of the post-focusing electrode. The post-focusing electrode is partitioned from the focusing electrode.

6 Claims, 2 Drawing Sheets

ELECTRON GUN FOR A COLOR CATHODE RAY TUBE

BACKGROUND OF THE INVENTION

This invention relates to an electron gun for a color cathode ray tube, and more particularly to the electron gun in which, by improving the convergence characteristics of the electron beams, resolution of the cathode ray tube can be elevated.

The color cathode ray tube includes a bulb having a face plate on the inner side of which a fluorescent material is applied, a funnel integrally joined to the face plate, and a neck joined to the funnel.

An electron gun is installed on the inside of the neck of the bulb. The electron gun emits three electron beams. The electron beams emitted from the electron gun pass through apertures of a shadow mask, and then strike fluorescent pixels of the screen, thereby displaying a picture on a screen.

High resolution of a picture formed out of the fluorescent pixels can be achieved through minimizing the diameter of the electron beams.

However, the way of converging three electron beams to a single point puts a limit in elevating resolution since the structure of an electric field becomes changed as focusing voltages applied to a focusing electrode is changed.

FIG. 2 illustrates a sectional side elevation of a conventional multiple focusing electron gun. First to fourth electrodes 4, 6, 8 and 10 are arranged in order beginning from a cathode 2 and spaced from one another.

The cathode 2, the first electrode 4 and the second electrode 6 are altogether three polar parts and regulate the discharging amount of the electrons in response to an external signal. The third electrode 8 and the fourth electrode 10 form a main-lens therebetween to form a fine electron beam.

The electron beam is preliminarily focused by a pre-focusing lens formed between the second electrode 6 and the third electrode 8. Then, the electron beam is substantially focused in the field of the main lens.

In the electron gun as described above, three lines of electron beams are converged to a point by off-setting the distances between the centers of the apertures of the third electrode with respect to the distances between the centers of the corresponding apertures of the fourth electrode.

In the electron gun, the process for displaying a picture on the screen includes several steps. That is, first, thermal electrons are emitted from the cathode 2. Second, the emitted electrons are crossed over while passing through the first electrode 4. Third, the electrons crossed over are accelerated by the second electrode 6. Fourth, the accelerated electrons are focused by the third electrode 8. Finally, a picture is displayed on the screen 12 out of the focused electrons by the fourth electrode.

In general, there are two methods for focusing the electron beams to a point. That is, one method is to focus the electron beams on the last electrode by off-setting the eccentric distances between the apertures of the focusing electrode with respect to the eccentric distances between the corresponding apertures of the last electrode. The other method is to focus the electron beams by gradually reducing the center distances of each electrode beginning from the first electrode to the last electrode.

However, when the focusing voltage is changed, the electron beams move in accordance with the change of the equipotential line, the line being a connector of equivalent voltages. That is, when the focusing voltage is higher, the distance between the side electron beams R and B is increased, while when the focusing voltage is lower, the distance between the side electron beams is decreased.

As a result, in the operation like that above, resolution of the cathode ray tube deteriorates since when the focusing voltage is changed, the movement paths of the electron beams are changed, and thus a misconvergence is generated.

Particularly, this type of the electron gun results in inferior resolution on the circumference of the screen. Therefore, the multi-focusing electron gun which has a third electrode divided has been proposed to improve the resolution on the circumference of the screen.

SUMMARY OF THE INVENTION

It is an object of the present invention to provide an electron gun for a color cathode ray tube in which uniform resolution can be obtained over the entire screen surface through minimizing the change of the movement paths of the electron beams caused by the change of the focusing voltage.

To achieve the above objective, the present invention provides an electron gun for a color cathode ray tube taking a multi-level focusing form in which the distances between the centers of the apertures of a focusing electrode are larger than those of the corresponding apertures of a pre-focusing electrode.

Preferably, the center distances between the apertures of the focusing electrode are larger than the center distances between the corresponding apertures of a post-focusing electrode.

Furthermore, it is preferable that the distances between the centers of the apertures of the pre-focusing electrode are equal to the distances between the centers of the corresponding apertures of the post-focusing electrode.

While the pre-focusing electrode is a plate electrode, the post-focusing electrode is partitioned from the focusing electrode.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION

A preferred embodiment of the present invention will now be described in detail with reference to the accompanying drawings.

Figure 1:
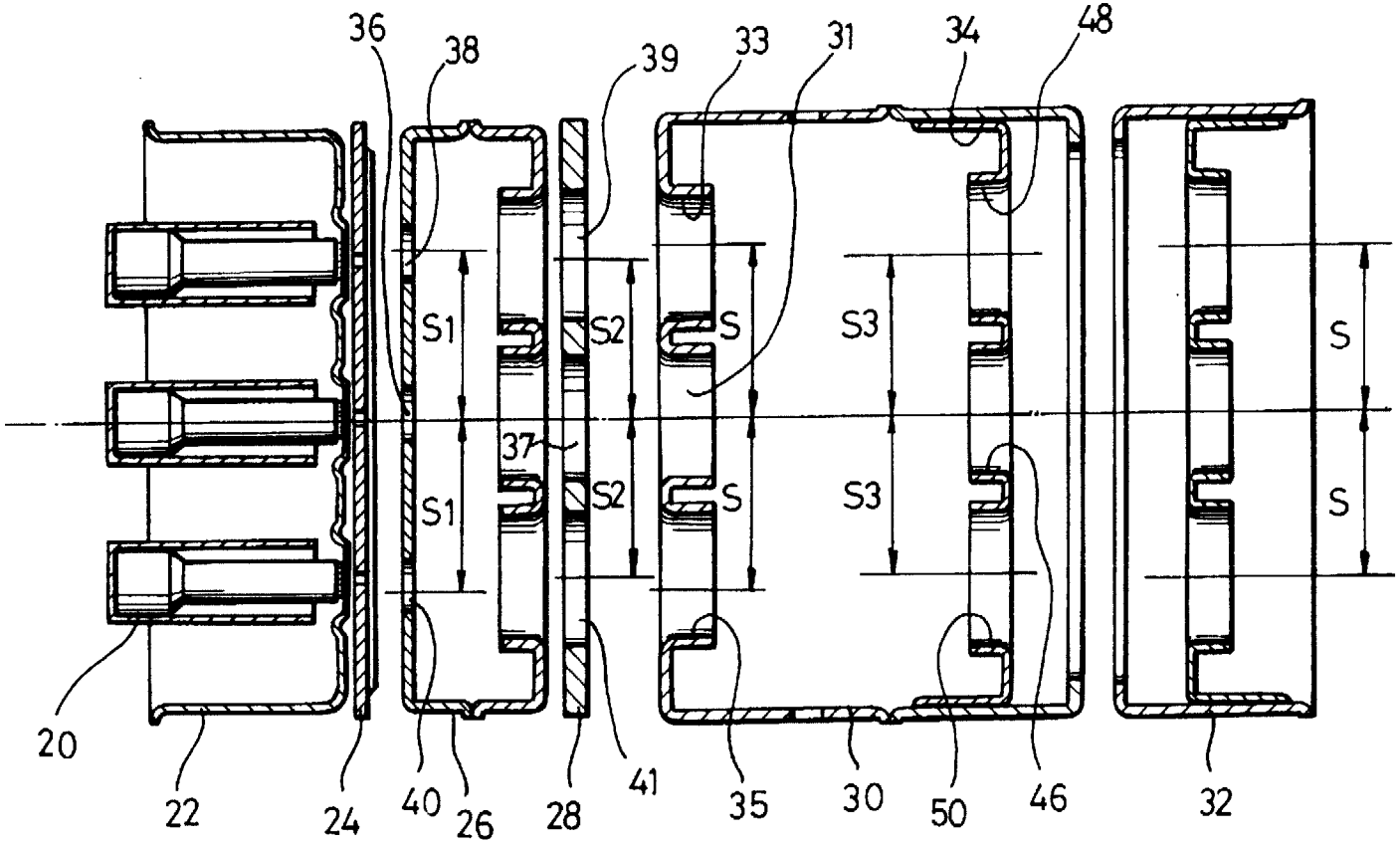
FIG. 1 is a sectional side elevation illustrating an electrode arrangement of the electron gun according to a preferred embodiment of the present invention.
Figure 2:
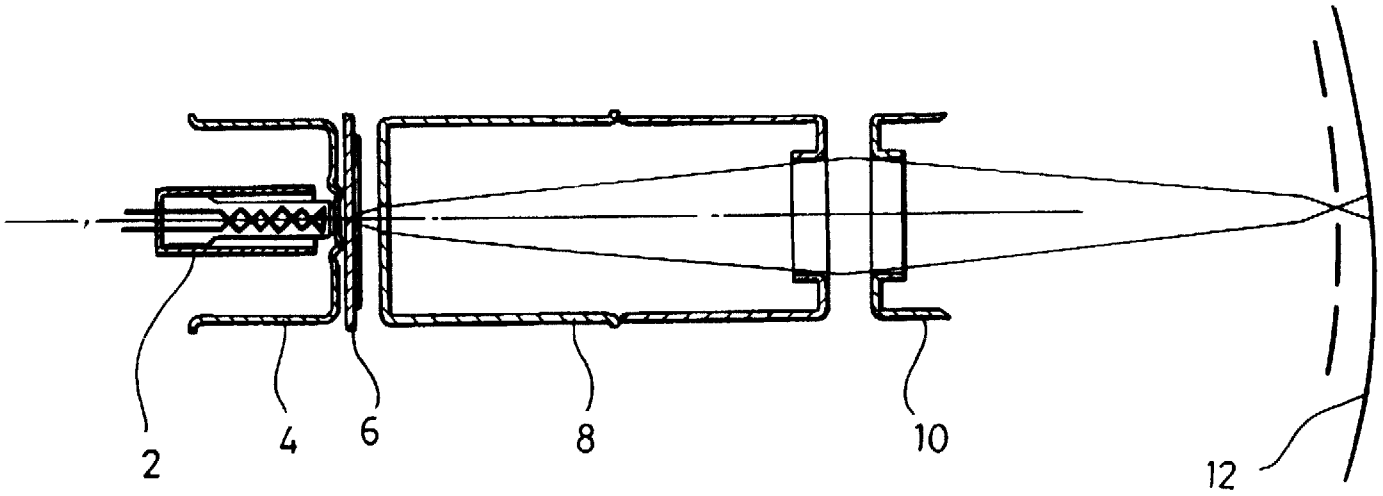
FIG. 2 (Prior Art)
FIG. 2 is a schematic view illustrating a conventional electron gun.

Referring to FIG. 1, a cathode 20 is illustrated on the left side of the drawing. A first electrode 22, a second electrode 24, a third electrode 26, a pre-focusing electrode 28, a fourth electrode 30 which is the focusing electrode and a fifth electrode 32 which is the last electrode are successively arranged beginning from the cathode 20. The pre-focusing electrode 28 is a plate electrode.

An electron gun according to a preferred embodiment of the present invention is furnished with a focusing electrode 30, a pre-focusing electrode 28 and a post-focusing electrode 34. The pre-focusing electrode 28 is applied to the equivalent voltage to the one applied to the second electrode 24. The second electrode 24 accelerates the speed of the electron beam. The post-focusing electrode 34 is positioned on the inside of the focusing electrode 30. To decrease the influence input from the change of the focusing voltage to the electron beams, the distance between, the center of a G beam aperture 31 and the center of an R beam aperture 33 as well as between the center of the G beam aperture 31 and the center of a B beam aperture 35 in the focusing electrode 30, is larger than the distance between the center of an G beam aperture 37 and the center of a R beam aperture 39 as well as between the center of the G beam aperture 37 and the center of a B beam aperture 41 in the focusing beam electrode 28. But, the center distances between apertures of the post-focusing electrode 34 are equal to the center distances between the corresponding apertures of the pre-focusing electrode 28.

The post-focusing electrode 34 is partitioned from the focusing electrode 30, improving resolution on the circumference of the screen.

The electron gun is further furnished with the third electrode 26. In the third electrode 26, the distance S1 between the center of a G beam aperture 36 and the center of an R beam aperture 38 as well as between the center of the G beam aperture and the center of a B beam aperture 40 is larger than the distance S2 between the center of the G beam aperture 37 and the center of the R beam aperture 39 as well as between the center of the G beam aperture 37 and the center of the B beam aperture 41 in the pre-focusing electrode 28.

And, the distances S2 between the apertures of the pre-focusing electrode 28 are equal to the distances S3 between the center of the G beam aperture 46 and the R beam aperture 48 or the B beam aperture 50 in the post-focusing electrode 34.

It is possible for the electron beams, particularly the side R beam and the side B beam to pass through the main electrode, that is the focusing electrode, with a regular incidence angle. Because the movement paths of the electron beams, particularly the side R beam and the side B beam become less changed since the distances between the centers of the apertures of the focusing electrode are larger than the center distances between the corresponding apertures of the forward focusing electrode.

Therefore, the convergence character on the screen circumference is elevated since the momentum of the electron beams is little even when the focusing voltage is changed.

While this invention has been described in connection with what is presently considered to be the most practical and preferred embodiment, it is to be understood that the invention is not limited to the disclosed embodiments, but, on the contrary, it is intended to cover various modifications and equivalent arrangements included within the spirit and scope of the appended claims.

What is claimed is:

1. An electron gun for a color cathode ray tube comprising:

a focusing electrode having apertures; and a pre-focusing electrode having apertures, wherein the distances between the centers of the apertures of the pre-focusing electrode are smaller than the distances between the centers of the corresponding apertures of the focusing electrode.

2. The electron gun of claim 1 further comprising a post-focusing electrode having apertures, wherein the distances between the centers of the apertures of the focusing electrode are larger than the distances between the centers of the corresponding apertures of the post-focusing electrode.

3. The electron gun of claim 2 wherein the distances between the centers of the apertures of the pre-focusing electrode are substantially equal to the distances between the centers of the corresponding apertures of the post-focusing electrode.

4. The electron gun of claim 1 wherein the pre-focusing electrode is a plate electrode.

5. The electron gun of claim 1 wherein the post-focusing electrode is partitioned from the focusing electrode.

6. The electron gun of claim 3 wherein the post-focusing electrode is partitioned from the focusing electrode.

* * * * *